United States Patent [19]

Giussani

[11] 4,193,620

[45] Mar. 18, 1980

[54] DOOR LATCH

[76] Inventor: Franco Giussani, Via Oslavia, 80, Desio (Milan), Italy

[21] Appl. No.: 872,657

[22] Filed: Jan. 26, 1978

[30] Foreign Application Priority Data

Jan. 26, 1977 [IT] Italy ..... 19659 A/77

[51] Int. Cl.[2] ..... E05C 1/12

[52] U.S. Cl. ..... 292/169.17; 70/485

[58] Field of Search ..... 70/144, 145, 152, 156, 70/467, 471, 481, 482, 483, 484, 485; 292/169.14, 169.15, 169.17

[56] References Cited

U.S. PATENT DOCUMENTS

| | | | |
|---|---|---|---|
| 2,400,403 | 5/1946 | Falk | 292/169.17 |
| 2,503,192 | 4/1950 | Cerf, Jr. | 292/169.17 |
| 2,651,934 | 9/1953 | Chesler | 70/485 |

*Primary Examiner*—Kenneth Dorner

*Attorney, Agent, or Firm*—Diller, Ramik & Wight

[57] ABSTRACT

A door lock which includes inner and outer attachment plates for securement to a door carrying a latch operated by a rod from the exterior or the interior of an associated door, a locking slide movable toward and away from the rod which is held adjacent the rod to lock the same by a pivotal locking tab which is pivoted for movement about an axis generally parallel to the rod, and the locking tab being capable of being operated from both exteriorally and interiorally of the associated door.

7 Claims, 5 Drawing Figures

DOOR LATCH

This invention relates to an improved door latch which exhibits, quite characteristically, a mechanism for blocking the latch proper, contained in a boxlike envelope having a very flat form and which is applied to the inner surface of the door.

Cylinder locks are known in which the latching member proper is manually controlled by either of two knobs or handles, which are interconnected by a rod: the latter actuates a selective blocking mechanism of the latching member.

Such a mechanism is entirely contained in a hollow space formed through the door thickness and can be controlled either by a key or by a safety bolt.

To install such locks is made comparatively laborious and expensive on account of the fact that an appropriate chamber must be formed through the door thickness and has such a size as considerably to weaken the door structure.

The principal object of the present invention is to provide a lock of the kind referred to above which has such a configuration as to require for its installation the provision of a hollow space of small size and tiny through-bores.

Another object of the invention is to provide a lock having a latching member blocking mechanism of an extremely simple construction.

Having these objects in view, according to the invention, it has been envisaged to provide a door lock of the cylinder type which comprises two knobs, handles or similar means, mounted, respectively, on the interior and on the outer surface of the door for the manual control of a latching member by virtue of the rotation of a through-rod which interconnects such knobs or handles and is operatively connected to the latching member, said lock being characterized in that, in a boxlike envelope fastened to the inner surface of the door, a mechanism for locking said rod is contained, said mechanism being selectively actuable by rotation of the cylinder shaft or from the outside of the door by a key or also from the interior by a manual control means.

The structural and functional features of the invention and its advantages over the prior art will become still more conspicuous from the exemplary description given hereinafter with reference to the accompanying drawings, wherein.

Figure 1:
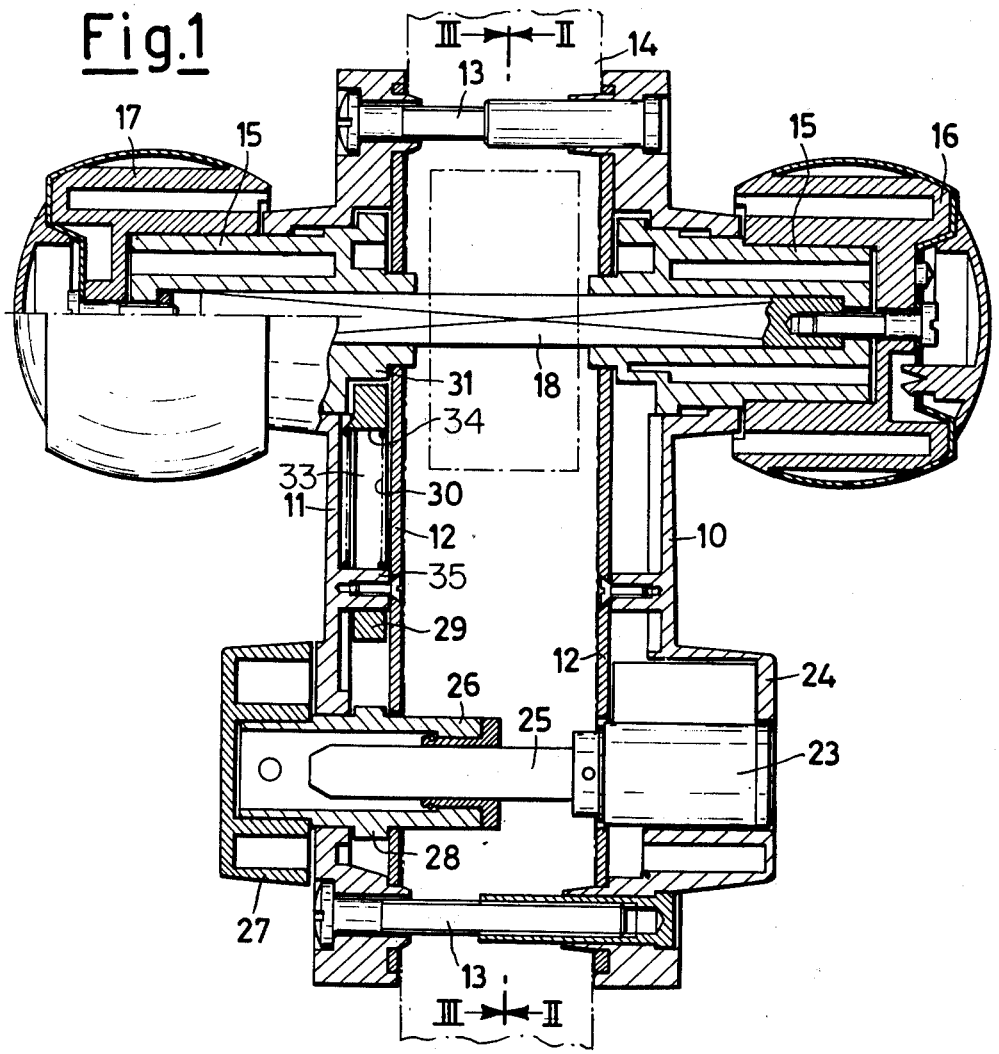
FIG. 1 is a vertical cross-sectional view showing a lock embodying the principles of this invention.

Having now reference, at the outset, to FIG. 1 of the drawings, the lock according to this invention is structurally composed by two boxlike envelopes 10, 11 which are closed by plates such as 12 and fastened by screws 13 to the respective inner and outer surfaces of a door slab, diagrammatically indicated at 14.

The envelopes 10, 11 carry, each, a pin 15 on which respective knobs 16, 17 can be rotated and are interconnected by a square rod 18.

Figure 5:
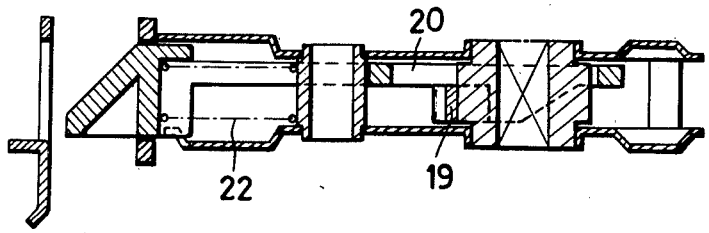
FIG. 5 is a cross-sectional view taken along the line V—V of FIG. 4.
Figure 4:
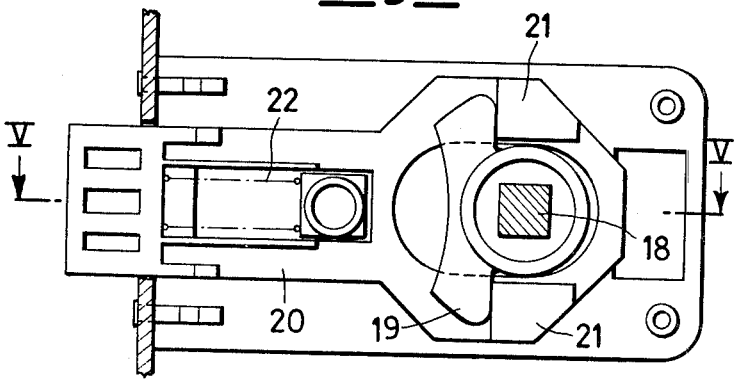
FIG. 4 is a detailed side elevational view of the latching member proper of the lock.

As can be seen in FIGS. 4 and 5 of the drawings, the rod 18 carries, mounted thereon, a lever 19 for controlling the latching member 20 of the lock. The lever 19, actually, acts with its ends upon two abutments 21 of the latching member 20, the latter being constantly biassed by a spring 22 towards the closed position.

The manipulation of the latching member 20 by the knobs 16 (or 17 as the case may be) is selectively prevented by a safety cylinder 23 which is contained within a seating 24 of the outer envelope 10. From the cylinder 23, through the door thickness 14, there extends a rotatable shaft 25. To the latter there is affixed an enlarged portion 26 passed through the outer envelope 11 and terminated by a tiny manipulation knob 27.

The rotation of the shaft 25-26 can thus be controlled from the outside by an appropriate key slipped into the safety cylinder 23, and, from the inside, by a mere manual rotation of the knob 27.

Figure 2:
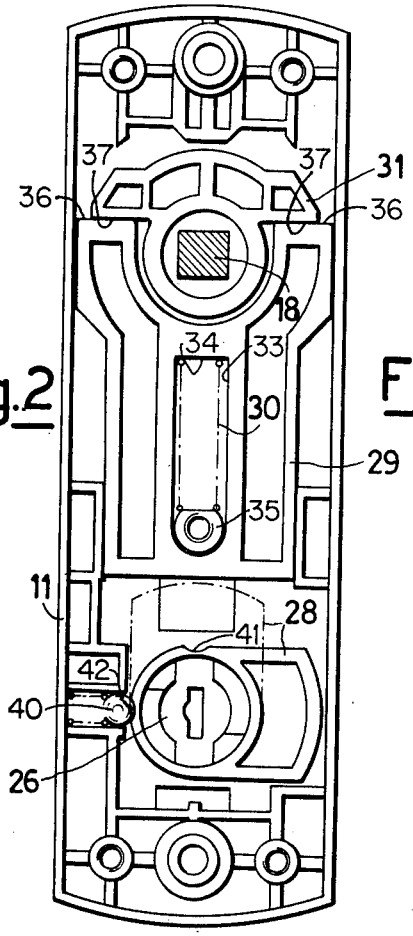
FIGS. 2 and 3 are two cross-sectional views, taken along the lines II—II and III—III of FIG. 1, respectively.
Figure 3:
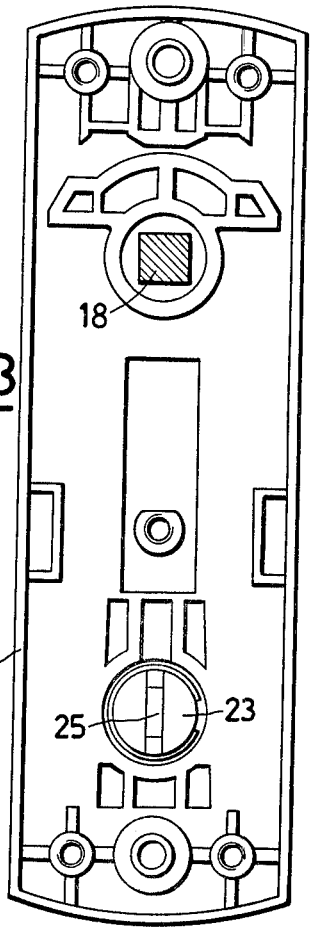

As can be seen in FIGS. 2 and 3 of the drawings, the enlarged portion 26 carries, integral with it, a radial tab 28. The latter, by a 90-degree rotation of the shaft 25-26 is selectively switchable between the horizontal and the vertical position as shown in FIG. 2 by solid lines and in phantom, respectively. The tab 28 coacts with the bottom end of slide 29. The slide 29 slides within the envelope 11 and has its top end biassed by a spring 30. The spring 30 is positioned in an elongated slot 33 (FIGS. 1 and 2) of the slide 29 and bears against an upper surface 34 of the slot 33 and against a supporting element 35 carried by the envelope 11. The slide 29 carries abutment means 36 which contact or abut abutment means 37 of a lever 31 carried by the rod 18. The lever 31 is integral with the rod 18 which connects the knobs 16, 17 to one another.

It is thus apparent that, when the tab 28 is arranged in its vertical position as depicted in FIG. 2 in phantom, the downward shift of the slide 29 is prevented, and thus the rotation of the lever 31 is likewise impeded, the same being true of the lever 31, the rod 18 and both the knobs 16, 17 fastened to the rod. The latching member is thus immovable in the outstretched position of FIGS. 4 and 5 of key lock of the door 14. When, conversely, the tab 28 is horizontal as shown in solid lines in FIG. 2, the slide 29 is freely slidable downward as urged by the rotation of the lever 31 integral with the rod 18, the latter being rotated by either knob 16 or 17, so that the lever 19, which is likewise integral with the rod 18, will rotate with the latter and will withdraw the latching member 20 so that the door 14 can be opened. The tab 28 is, of course, locked in a yieldable releasable fashion in its vertical and horizontal positions by the engagement of a spring biased detent means or ball 40 with respective notches or recesses 41, 42 of the tab 28.

A safety lock has thus been provided, which can be mounted on a door in a simple and quick manner without any necessity of hollow spaces of considerable size through the door thickness, but by merely forming two through-bores for the screws 13, for the rod 18, for the shaft 25-26 and a tiny seat for the latching member 20.

While a possible embodiment of the invention has been shown and described, it will be understood that modifications and changes can be introduced therein without departing from the scope of the invention as defined in and by the appended claims.

I claim:

1. A door lock comprising inner and outer means for attachment at inner and outer surfaces of a door, latching means between said attachment means for latching a door to an associated door jamb, rod means for operating said latching means from the exterior of said inner and outer attachment means, locking means for selectively permitting and preventing rotation of said rod means from a door latching position to a door unlatching position, said locking means including a locking slide mounted for sliding movement upon one of said inner and outer attachment means generally transversely toward and away from said rod means, means normally biasing said locking slide in a direction toward said rod means and away from said locking tab, means mounting a locking tab for pivoting movement about an axis generally parallel to the axis of said rod means between a first position at which said tab prevents sliding movement of said locking slide away from said rod means and consequently locks said rod means in said door latching position and a second position at which said tab permits sliding movement of said locking slide away from said rod means and consequently unlocks said rod means in said door unlatching position, and means for operating said locking tab from both the exterior and interior of an associated door.

2. The door lock as defined in claim 1 wherein said locking slide includes first abutment means for contacting second abutment means carried by said rod means when said tab is in its first position whereby every rotation of said rod means to said door unlatching position causes a simultaneous sliding movement of said locking slide away from said rod means.

3. The door lock as defined in claim 2 wherein said first and second abutment means abut each other at generally diametrically opposite sides of said rod means.

4. The door lock as defined in claim 1 wherein said locking slide includes an elongated slot, a supporting element carried by one of said inner and outer attachment means and being disposed in said slot, and said biasing means being disposed in said slot in bearing relationship between said locking slide and said supporting element.

5. A door lock comprising inner and outer means for attachment at inner and outer surfaces of a door, latching means between said attachment means for latching a door to an associated door jamb, rod means for operating said latching means from the exterior of said inner and outer attachment means, locking means for selectively permitting and preventing rotation of said rod means from a door latching position to a door unlatching position, said locking means including a locking slide mounted for sliding movement upon one of said inner and outer attachment means generally transversely toward and away from said rod means, means mounting a locking tab for pivoting movement about an axis generally parallel to the axis of said rod means between a first position at which said tab prevents sliding movement of said locking slide away from said rod means and consequently locks said rod means in said door latching position and a second position at which said tab permits sliding movement of said locking slide away from said rod means and consequently unlocks said rod means in said door unlatching position, means for operating said locking tab from both the exterior and interior of an associated door, said locking slide including first abutment means for contacting second abutment means carried by said rod means when said tab is in its first position whereby every rotation of said rod means to said door unlatching position causes a simultaneous sliding movement of said locking slide away from said rod means, said first and second abutment means abut each other at generally diametrically opposite sides of said rod means, said locking slide being of a generally Y-shaped configuration defined by a leg and a pair of arms, said first abutment means are carried by said arms, and said rod means is disposed between said arms when said first and second abutment means are in contact.

6. The door lock as defined in claim 5 wherein said locking slide includes an elongated slot, a supporting element carried by one of said inner and outer attachment means and being disposed in said slot, and biasing means being disposed in said slot in bearing relationship between said locking slide and said supporting element.

7. A door lock comprising inner and outer means for attachment at inner and outer surfaces of a door, latching means between said attachment means for latching a door to an associated door jamb, rod means for operating said latching means from the exterior of said inner and outer attachment means, locking means for selectively permitting and preventing rotation of said rod means from a door latching position to a door unlatching position, said locking means including a locking slide mounted for sliding movement upon one of said inner and outer attachment means generally transversely toward and away from said rod means, means mounting a locking tab for pivoting movement about an axis generally parallel to the axis of said rod means between a first position at which said tab prevents sliding movement of said locking slide away from said rod means and consequently locks said rod means in said door latching position and a second position at which said tab permits sliding movement of said locking slide away from said rod means and consequently unlocks said rod means in said door unlatching position, means for operating said locking tab from both the exterior and interior of an associated door, and spring biased detent means for yieldably releasably locking said tab in its first position.

* * * * *